US011232746B2

(12) United States Patent
Wang et al.

(10) Patent No.: US 11,232,746 B2
(45) Date of Patent: Jan. 25, 2022

(54) PIXEL CIRCUIT OF ORGANIC LIGHT EMITTING DEVICE AND ORGANIC LIGHT EMITTING DISPLAY PANEL

(71) Applicant: Wuhan China Star Optoelectronics Semiconductor Display Technology Co., Ltd., Hubei (CN)

(72) Inventors: Chunyang Wang, Hubei (CN); Qi Ouyang, Hubei (CN)

(73) Assignee: WUHAN CHINA STAR OPTOELECTRONICS SEMICONDUCTOR DISPLAY TECHNOLOGY CO., LTD.

( * ) Notice: Subject to any disclaimer, the term of this patent is extended or adjusted under 35 U.S.C. 154(b) by 153 days.

(21) Appl. No.: 15/733,074

(22) PCT Filed: Jun. 26, 2019

(86) PCT No.: PCT/CN2019/092967
§ 371 (c)(1),
(2) Date: May 7, 2020

(87) PCT Pub. No.: WO2020/215480
PCT Pub. Date: Oct. 29, 2020

(65) Prior Publication Data

US 2021/0398482 A1 Dec. 23, 2021

(30) Foreign Application Priority Data

Apr. 22, 2019 (CN) ..... 201910323027.7

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01); *G09G 2300/0842* (2013.01); *G09G 2310/08* (2013.01); *G09G 2320/0252* (2013.01); *G09G 2320/045* (2013.01)

(58) Field of Classification Search
CPC ..... G09G 3/3233; G09G 2300/0426; G09G 2300/0819; G09G 2300/0842; G09G 2310/08; G09G 2320/0252; G09G 2320/045
See application file for complete search history.

(56) References Cited

U.S. PATENT DOCUMENTS

2008/0211397 A1* 9/2008 Choi ..... G09G 3/3233 313/504
2012/0062536 A1* 3/2012 Park ..... G09G 3/3233 345/211
2013/0069852 A1* 3/2013 Liao ..... G09G 3/3233 345/77

(Continued)

*Primary Examiner* — Jeff Piziali
(74) *Attorney, Agent, or Firm* — Luedeka Neely Group, P.C.; Rick Barnes

(57) ABSTRACT

A pixel circuit of an organic light emitting device and an organic light emitting display panel are disclosed. Two steps of a pixel circuit duty cycle can be realized by completing initialization in synchronization during the program period at same time, maintaining a gate voltage of a driving transistor, and compensating for a threshold voltage drift in the driving transistor. Thereby improving response speed of the organic light emitting device, and increasing refresh rate of the display panel.

20 Claims, 5 Drawing Sheets

(56) References Cited

U.S. PATENT DOCUMENTS

| | | | | |
|---|---|---|---|---|
| 2015/0262526 | A1* | 9/2015 | Park | G09G 3/3233 345/76 |
| 2016/0275869 | A1* | 9/2016 | Hwang | G09G 3/3258 |
| 2016/0284273 | A1* | 9/2016 | Ma | G09G 3/3233 |
| 2017/0116918 | A1* | 4/2017 | Dong | G09G 3/3233 |
| 2017/0301293 | A1* | 10/2017 | Zhu | G09G 3/3208 |
| 2018/0374415 | A1* | 12/2018 | Morita | H01L 27/1251 |

* cited by examiner

PIXEL CIRCUIT OF ORGANIC LIGHT EMITTING DEVICE AND ORGANIC LIGHT EMITTING DISPLAY PANEL

FIELD OF INVENTION

The present disclosure relates to a display field, particularly relates to a pixel circuit of an organic light emitting device, and an organic light emitting display panel.

BACKGROUND OF INVENTION

Generally, organic light emitting devices include organic light emitting diodes (OLEDs) and active matrix organic light emitting diodes (active matrix OLEDs, AMOLEDs), and according to ways of driving electroluminescent (EL) elements, are divided into current driven OLEDs and voltage driven OLEDs.

Although AMOLED panels have an advantage of low power consumption, there is a problem that current intensity flowing through the EL elements changes with time so that causes display unevenness. This is derived from a voltage between a gate and a source of a driving transistor for driving the EL element, that is, change in a threshold voltage of the driving transistor, causing the current flowing through the EL element to change. In an AMOLED panel, for ensuring uniform illumination of a panel, compensating a threshold voltage variation of a driving transistor, and maintaining stability of current of the EL element in a cycle, a complicated pixel circuit of a light emitting device is required.

Referring to FIG. 1 and FIG. 2, wherein FIG. 1 is a schematic diagram of a pixel circuit of a conventional organic light emitting device, and FIG. 2 is a waveform diagram of an operation of the pixel circuit shown in FIG. 1.

As shown in FIG. 1, the pixel circuit includes first to sixth transistors T11 to T16, a capacitor C11, and an electroluminescence element EL11. The first transistor T11 is a driving transistor; a gate electrode of the first transistor T11 is connected to a bottom polar plate of the capacitor C11; a source electrode of the first transistor T11 is connected to a drain electrode of the second transistor T12; a drain electrode of the first transistor T11 is connected to a source electrode of the third transistor T13; an upper polar plate of the capacitor C11 is accessed a power source voltage VDD. The second transistor T12 is a switch transistor; a gate electrode of the second transistor T12 is connected to a nth row scanning signal line Scan(n); a source electrode of the second transistor T12 is accessed a data voltage Vdata. The third transistor T13 is a threshold voltage compensation transistor; a gate electrode of the third transistor T13 is connected to the nth row scanning signal line Scan(n); a drain electrode of the third transistor T13 is connected to the gate electrode of the first transistor T11. The fourth transistor T14 is an initialization transistor; a gate electrode of the fourth transistor T14 is connected to a n−1th row scanning signal line Scan(n−1); a source electrode is connected to the bottom polar plate of the capacitor C11; and a drain electrode of the fourth transistor T14 is accessed an initialization voltage Vinit. The fifth transistor T15 is also a switch transistor; a gate electrode of the fifth transistor T15 is connected to a nth row light emitting line EM (n); a source electrode of the fifth transistor T15 is accessed the power source voltage VDD; a drain electrode of the fifth transistor T15 is connected to the source electrode of the first transistor T11. The sixth transistor T16 is also a switch transistor; a gate electrode of the sixth transistor T16 is connected to the nth row light emitting line EM (n); a source electrode of the sixth transistor T16 is connected to the drain electrode of the first transistor T11; a drain electrode of the sixth transistor T16 is connected to an anode of an electroluminescent element EL11, a cathode of the electroluminescent element EL11 is connected to a common ground end VSS.

As illustrated in FIG. 2, a duty cycle of the pixel circuit is divided into three levels, which are an initialization period, a program period, and a light emitting period. During the initialization period, the fourth transistor T14 is turned on, and the first to the third transistors T11-T13 and the fifth and the sixth transistors T15-T16 are turned off. The initialization voltage Vinit is turned on with the capacitor C11 to initialize the data signal already stored in the capacitor C11, that is, a gate voltage Vgate of the first transistor T11, so that makes the first transistor T11 can be written the gate voltage Vgate during the program period. During the program period, the fourth transistor T14 is turned off, the second and the third transistors T12-T13 are turned on, the fifth and the sixth transistors T15-T16 are turned off, the data voltage Vdata charges the capacitor C11, and the gate of the first transistor T11 is written with the gate voltage Vgate. During the light emitting period, the fourth transistor T14 is turned off, the second and the third transistors T12-T13 are turned off, the fifth and the sixth transistors T15-T16 are turned on, the capacitor C11 functions to maintain the gate voltage Vgate of the first transistor T11, and supplies a drive current to the electroluminescence element EL11 through the first transistor T11 to drive the electroluminescence element EL11 to emit light.

Such a complicated duty cycle limits the response speed of the AMOLED panel, thereby affecting the refresh rate of the AMOLED panel. Therefore, how to simplify the duty cycle of the pixel circuit and improve the refresh rate of the AMOLED panel have become an urgent problem to be solved.

SUMMARY OF INVENTION

The purpose of the present disclosure is to provide a pixel circuit of an organic light emitting device and an organic light emitting display panel, which can simplify a duty cycle of the pixel circuit and improve a refresh rate of the organic light emitting display panel.

In order to realize the purpose mentioned above, the present disclosure provides a pixel circuit of an organic light emitting device. The pixel circuit includes a driving transistor and an electroluminescent element; the pixel circuit includes: a scanning signal response module, a light emitting signal response module, a first capacitor and a second capacitor; the scanning signal response module includes a second transistor, a third transistor and a seventh transistor; the second transistor is for responding to a nth row scanning signal to transmit a data voltage; the third transistor is for responding to the nth row scanning signal to compensate threshold voltage drift of the driving transistor; the seventh transistor is for responding to the nth row scanning signal to control the first capacitor and the second capacitor to store the data voltage, or to control the second capacitor to store the data voltage and an initialization voltage released by the first capacitor, to maintain a gate voltage of the driving transistor, and wherein n is a positive integer greater than 1; the light emitting signal response module includes a fourth transistor, a fifth transistor, and a sixth transistor; the fourth transistor is for responding to a nth row light emitting signal to transmit the initialization voltage; the fifth transistor is for responding to the nth row light emitting signal to provide a power source voltage to the driving transistor; the sixth transistor is for responding to the nth row light emitting signal to provide a driving electric current generated by the driving transistor to the electroluminescent element, and polarities of the initialization voltage and the data voltage are opposite; the first capacitor is for storing the initialization voltage when the light emitting signal response module is turned on, storing the data voltage, or releasing the stored initialization voltage when the scanning signal response module is turned on; the second capacitor is for storing the data voltage, or storing the data voltage and the initialization voltage released by the first capacitor when the scanning signal response module is turned on; the driving transistor is for generating the driving electric current according to the data voltage; and the electroluminescent element is for emitting light according to the driving electric current.

In order to realize the purpose mentioned above, the present disclosure further provides a pixel circuit of an organic light emitting device. The pixel circuit includes a driving transistor and an electroluminescent element; the pixel circuit further includes: a scanning signal response module for responding to a nth row scanning signal to transmit a data voltage to maintain a gate voltage of the driving transistor and to compensate threshold voltage drift of the driving transistor, and wherein n is a positive integer greater than 1; a light emitting signal response module for responding to a nth row light emitting signal to transmit an initialization voltage; and polarities of the initialization voltage and the data voltage are opposite; a first capacitor for storing the initialization voltage when the light emitting signal response module is turned on, storing the data voltage, or releasing the stored initialization voltage when the scanning signal response module is turned on; a second capacitor for storing the data voltage when the scanning signal response module is turned on, or storing the data voltage and the initialization voltage released by the first capacitor when the scanning signal response module is turned on; the driving transistor for generating the driving electric current according to the data voltage; and the electroluminescent element is emitting light according to the driving electric current.

In order to realize the purpose mentioned above, the present disclosure further provides an organic light emitting display panel. The pixel circuit includes at least one pixel circuit, and the pixel circuit includes a driving transistor and an electroluminescent element; the pixel circuit further includes: a scanning signal response module for responding to a nth row scanning signal to transmit a data voltage to maintain a gate voltage of the driving transistor and to compensate threshold voltage drift of the driving transistor, and wherein n is a positive integer greater than 1; a light emitting signal response module for responding to a nth row light emitting signal to transmit an initialization voltage; and polarities of the initialization voltage and the data voltage are opposite; a first capacitor for storing the initialization voltage when the light emitting signal response module is turned on, storing the data voltage, or releasing the stored initialization voltage when the scanning signal response module is turned on; a second capacitor for storing the data voltage when the scanning signal response module is turned on, or storing the data voltage and the initialization voltage released by the first capacitor when the scanning signal response module is turned on; the driving transistor for generating the driving electric current according to the data voltage; and the electroluminescent element for emitting light according to the driving electric current.

The advantage of the present disclosure is that the present disclosure is through completing initialization in synchronization during the program period, maintaining a gate voltage of a driving transistor, and compensating for a threshold voltage drift in the driving transistor, two steps of a pixel circuit duty cycle (the program period and the light emitting period) can be realized, thereby improving response speed of the organic light emitting device, and increasing the refresh rate of the display panel.

DESCRIPTION OF DRAWINGS

To more clearly illustrate the technical solutions of the embodiments of the present disclosure, the accompanying figures of the present disclosure will be described in brief. Obviously, the accompanying figures described below are only part of the embodiments of the present disclosure, from which figures those skilled in the art can derive further figures without making any inventive efforts.

DETAILED DESCRIPTION OF PREFERRED EMBODIMENTS

Figure 1:
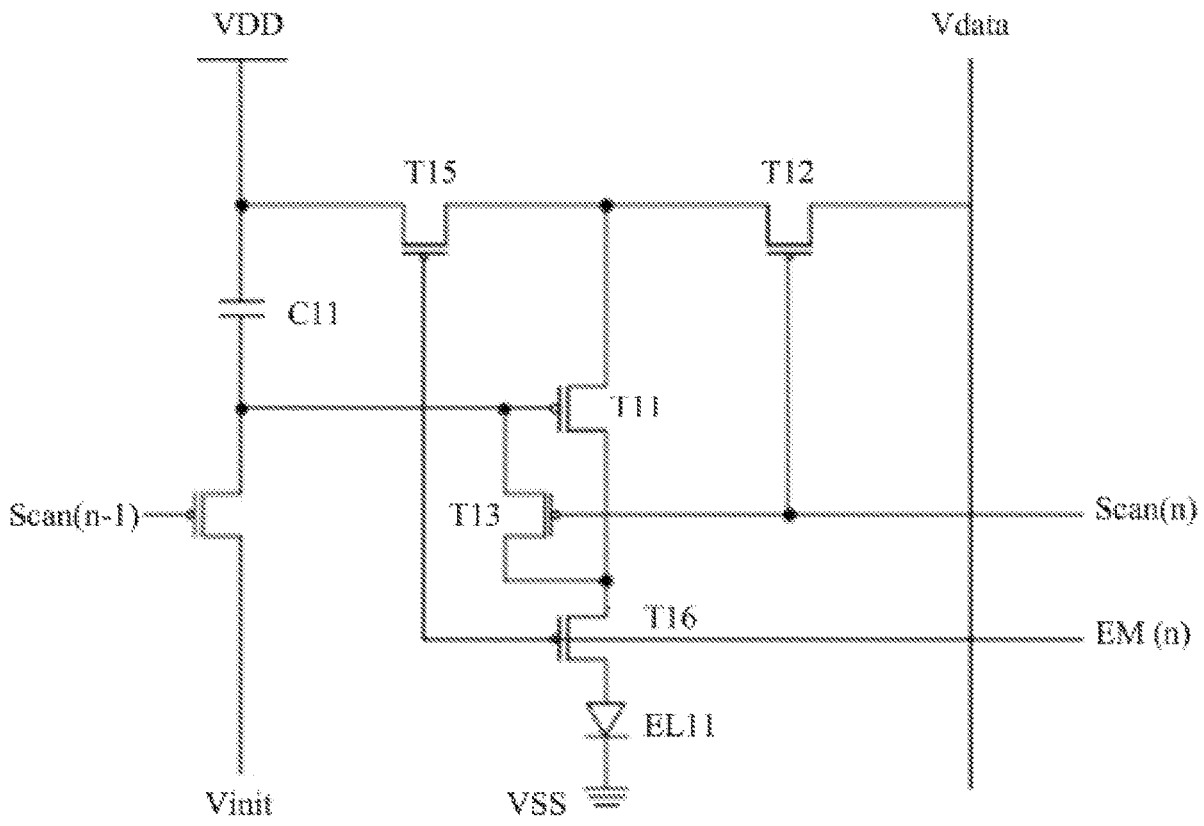
FIG. 1 is a schematic diagram of a pixel circuit of a current organic light emitting device.
Figure 2:
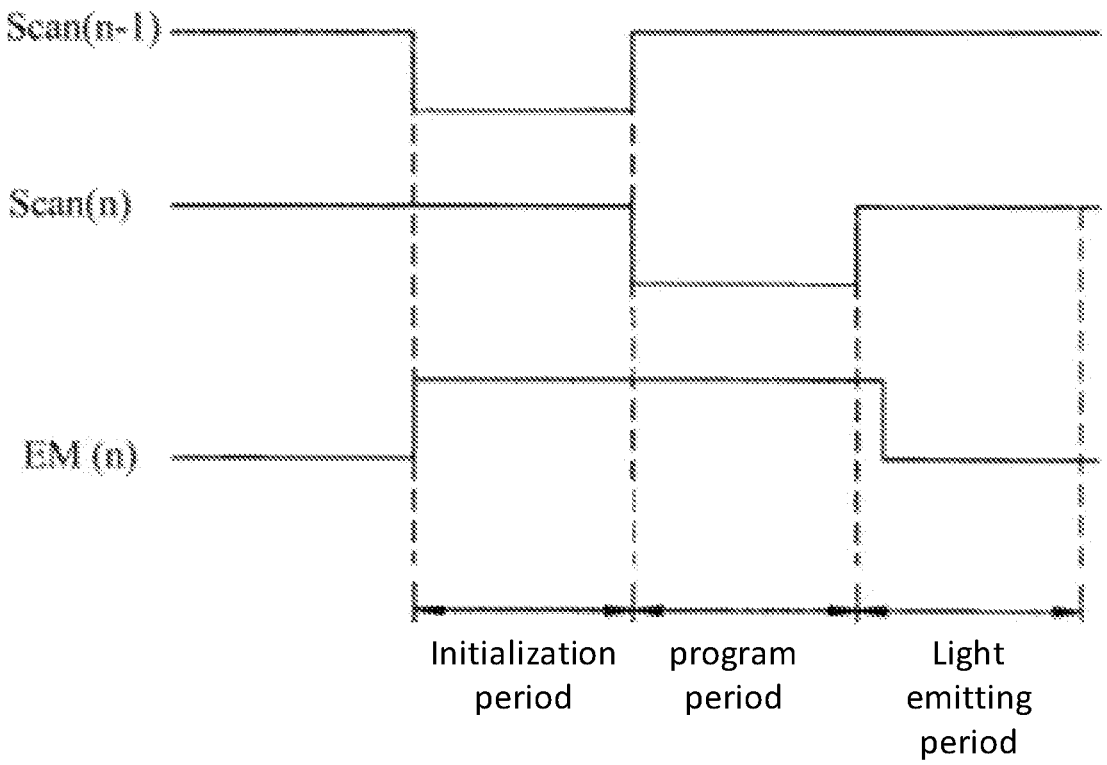
FIG. 2 is a waveform diagram of the operation of the pixel circuit illustrated in FIG. 1.

The embodiments of the present disclosure are described in detail hereinafter. Examples of the described embodiments are given in the accompanying drawings, wherein the identical or similar reference numerals constantly denote the identical or similar elements or elements having the identical or similar functions. The specific embodiments described with reference to the accompanying drawings are all exemplary and are intended to illustrate and interpret the present disclosure, which shall not be construed as causing limitations to the present disclosure.

The following disclosure provides many different embodiments or examples for implementing the different structures of the present disclosure. In order to simplify the disclosure of the present disclosure, the components and configurations of the specific examples are described below. Of course, they are merely examples and are not intended to limit the present disclosure. In addition, the present disclosure may repeat reference numerals and/or reference numerals in different examples, which are for the purpose of simplicity and clarity, and do not indicate the relationship between the various embodiments and/or arrangements discussed. Moreover, the present disclosure provides embodiments of various specific processes and materials, but one of ordinary skill in the art will recognize the use of other processes and/or the use of other materials.

In the present disclosure, unless expressly specified or limited otherwise, a first feature is "on" or "beneath" a second feature may include that the first feature directly contacts the second feature and may also include that the first feature does not directly contact the second feature. Furthermore, a first feature "on," "above," or "on top of" a second feature may include an embodiment in which the first feature is right "on," "above," or "on top of" the second feature and may also include that the first feature is not right "on," "above," or "on top of" the second feature, or just means that the first feature has a sea level elevation higher than the sea level elevation of the second feature. While first feature "beneath," "below," or "on bottom of" a second feature may include that the first feature is "beneath," "below," or "on bottom of" the second feature and may also include that the first feature is not right "beneath," "below," or "on bottom of" the second feature, or just means that the first feature has a sea level elevation lower than the sea level elevation of the second feature.

Figure 3:
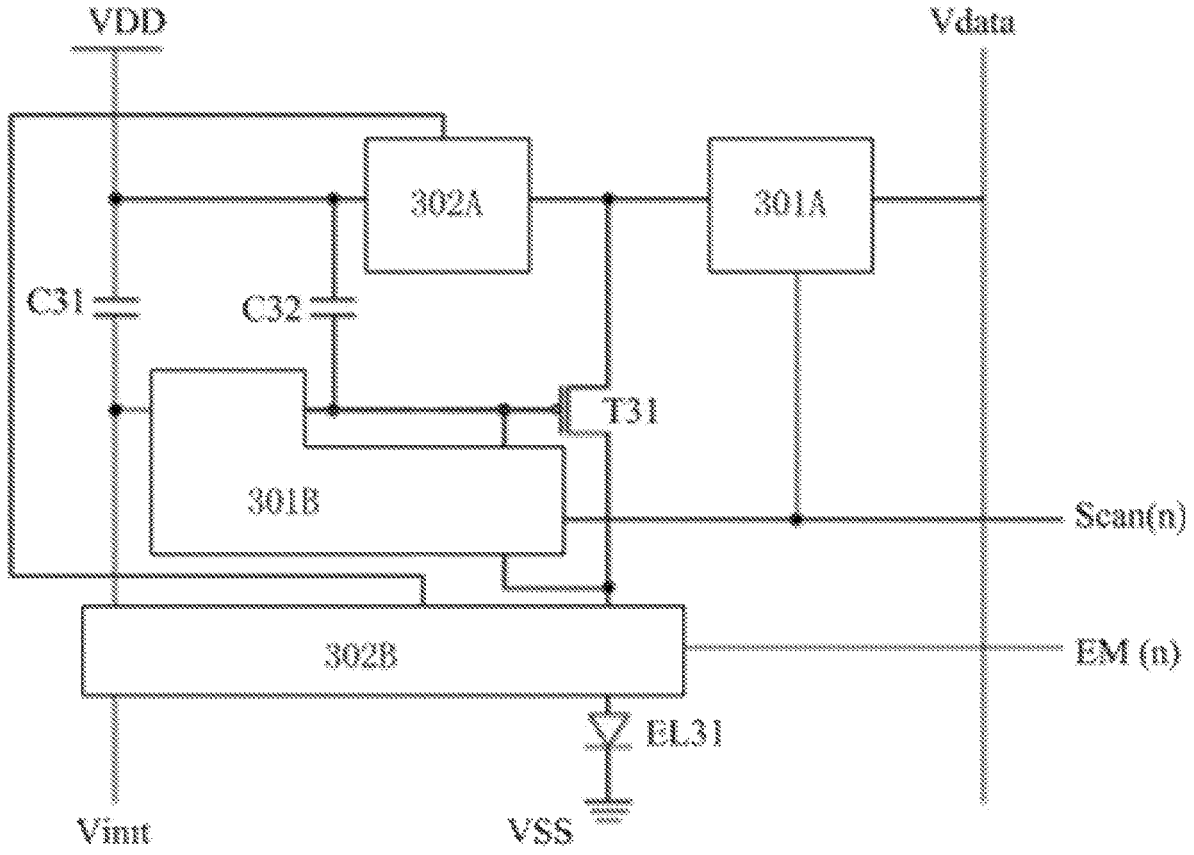
FIG. 3 is a structural schematic diagram of the pixel circuit of the organic light emitting device of the present disclosure.

Referring to FIG. 3, FIG. 3 is a structural schematic diagram of the pixel circuit of the organic light emitting device of the present disclosure. A pixel circuit 10 of an organic light emitting device of the present disclosure includes a driving transistor T31 which is a first transistor, an electroluminescent element EL1, a first capacitor C31, a second capacitor C32, a scanning signal response module 301 and a light emitting signal response module 302. To illustrate connection relations between the various components in convenient, the scanning signal response module 301 of FIG. 3 is shown in 301A and 301B, and the light emitting signal response module 302 is shown in 302A and 302B. The scanning signal response module 301 is for responding to a nth row scanning signal to transmit a data voltage Vdata, so that maintains a gate voltage of the driving transistor T31 and compensates threshold voltage drift of the driving transistor T31, and n is a positive integer greater than 1; the light emitting signal response module 302 is for responding to a nth row light emitting signal to transmit an initialization voltage Vinit; and polarities of the initialization voltage Vinit and the data voltage Vdata are opposite; the first capacitor C31 is for storing the initialization voltage Vinit when the light emitting signal response module 302 is turned on, storing the data voltage Vdata, or releasing the stored initialization voltage Vinit when the scanning signal response module 301 is turned on. The second capacitor C32 is for storing the data voltage Vdata, or storing the data voltage Vdata and the initialization voltage Vinit released by the first capacitor C31 when the scanning signal response module 302 is turned on; the driving transistor T31 is for generating a driving electric current according to the data voltage Vdata; and the electroluminescent element EL31 is for emitting light according to the driving electric current.

Specifically, the driving transistor T31 is a positive channel metal oxide semiconductor (PMOS) transistor; a gate electrode of the driving transistor T31 is respectively connected to the scanning signal response module 301 and the bottom polar plate of the second capacitor C32; a source electrode of the driving transistor T31 is accessed the data voltage Vdata by the scanning signal response module 301, and is accessed the power source voltage VDD by the light emitting signal response module 302 at same time; a drain electrode of the driving transistor T31 is connected to the scanning signal response module 301, and is connected to an anode of the electroluminescent element EL31 by the light emitting signal response module 302 at same time. The scanning signal response module 301 is respectively connected to a nth row scanning signal line Scan(n), the data voltage Vdata, a bottom polar plate of the first capacitor C31, a bottom polar plate of the second capacitor C32, and the light emitting signal response module 302. The light emitting signal response module 302 is respectively connected to a nth row light emitting line EM(n), the power source voltage VDD, the initialization voltage Vinit, the bottom polar plate of the first capacitor C31, and the anode of the electroluminescent element EL31. Upper polar plates of the first capacitor C31 and the second capacitor C32 are accessed the power source voltage VDD, and a cathode of the electroluminescent element EL31 is connected to a common ground end VSS.

During a program period, the scanning signal response module 301 responds to the nth row scanning signal and is turned on, the light emitting signal response module 302 responds to the nth row light emitting signal and is turned off, and the scanning signal response module 301 transmits the data voltage Vdata; when the currently transmitted data voltage Vdata is higher than the previously transmitted data voltage Vdata', the first capacitor C31 and the second capacitor C32 store the currently transmitted data voltage Vdata; when the currently transmitted data voltage Vdata is lower than the previously transmitted data voltage Vdata', the first capacitor C31 releases the stored initialization voltage Vinit, the second capacitor C32 stores the currently transmitted data voltage Vdata and stores the initialization voltage Vinit released by the first capacitor C31 to maintain a gate voltage of the driving transistor T31 and compensate threshold voltage drift of the driving transistor T31.

During a light emitting period, the scanning signal response module 301 responds to the nth row scanning signal and is turned off, the light emitting signal response module 302 responds to the nth row light emitting signal and is turned on; the light emitting signal response module 302 transmits the initialization voltage Vinit; the first capacitor C31 stores the initialization voltage Vinit, the driving transistor T31 generates the driving electric current to drive the electroluminescent element EL31 to emit light. Since the gate voltage of the driving transistor T31 is maintained at this time, the driving current during the light emitting period is ensured to be unchanged. Further, the threshold voltage drift of the driving transistor T31 can also be compensated.

By completing initialization in synchronization during the program period, maintaining the gate voltage of the driving transistor and compensating for the threshold voltage drift of the driving transistor, two steps of a pixel circuit duty cycle can be realized, thereby improving response speed of the organic light emitting device, and increasing a refresh rate of the display panel.

Figure 4:
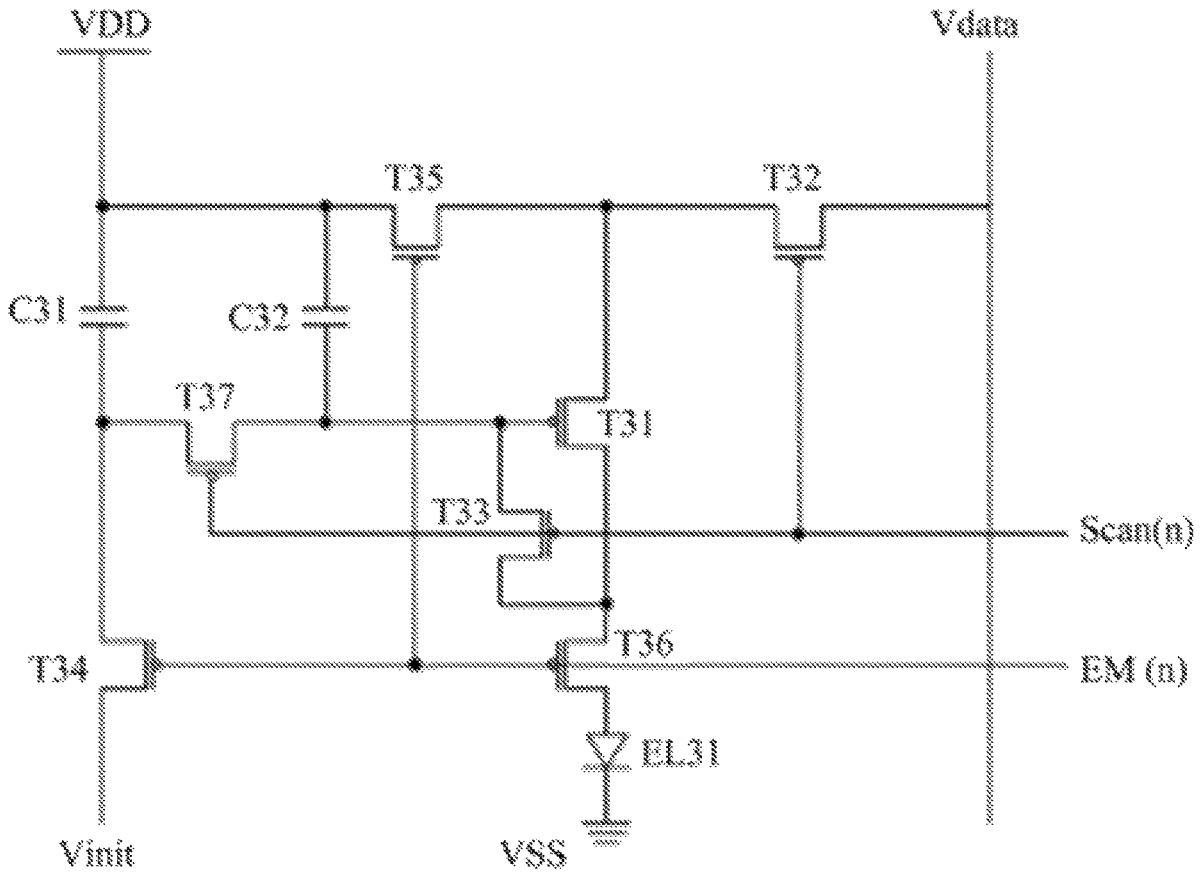
FIG. 4 is a circuit diagram of an embodiment of the pixel circuit of the organic light emitting device of the present disclosure.
Figure 5:
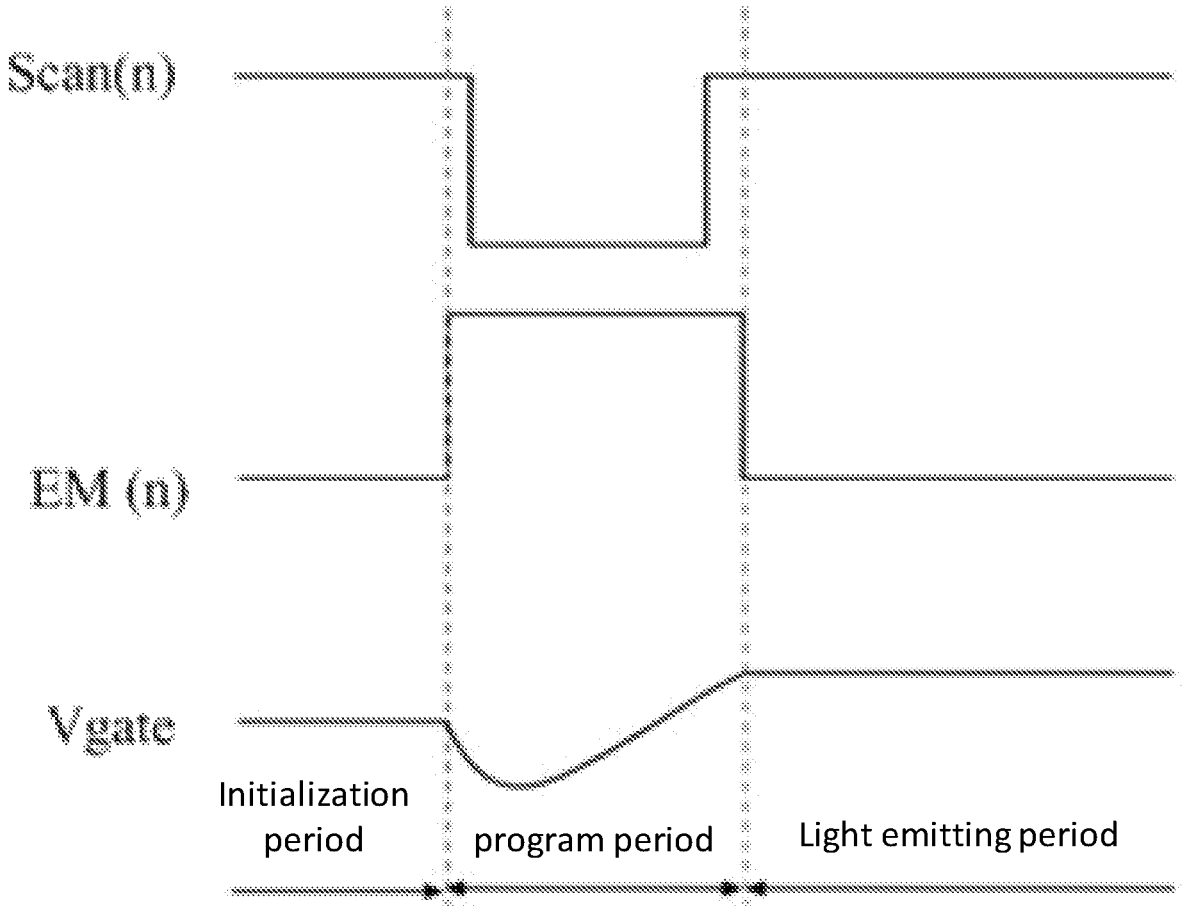
FIG. 5 is a waveform diagram showing operation of the pixel circuit illustrated in FIG. 4.

Please refer to FIG. 4 and FIG. 5, FIG. 4 is a circuit diagram of an embodiment of the pixel circuit of the organic light emitting device of the present disclosure, and FIG. 5 is a waveform diagram of the operation of the pixel circuit illustrated in FIG. 4.

As illustrated in FIG. 4, in this embodiment, the scanning signal response module 301 includes a second transistor T32, a third transistor T33 and a seventh transistor T37. The second transistor T32 is for responding to a nth row scanning signal to transmit a data voltage Vdata; the third transistor T33 is for responding to the nth row scanning signal to compensate threshold voltage Vth drift of the driving transistor T31; the seventh transistor T37 is for responding to the nth row scanning signal to control the first capacitor C31 and the second capacitor C32 to store the data voltage Vdata, or to control the second capacitor C32 to store the data voltage Vdata and the initialization voltage Vinit released by the first capacitor C31 to maintain the gate voltage of the driving transistor T31.

Specifically, in this embodiment, the second transistor T32, the third transistor T33, the seventh transistor T37, and the driving transistor T31 are PMOS transistors. A gate electrode of the second transistor T32 is connected to a nth row scanning signal line Scan(n); a source electrode of the second transistor T32 is accessed the data voltage Vdata; and a drain electrode of the second transistor T32 is connected to a source electrode of the driving transistor T31. A gate electrode of the third transistor T33 is connected to the nth row scanning signal line Scan(n); a source electrode of the third transistor T33 is connected to a drain electrode of the driving transistor T31 and coupled to an anode of the electroluminescent element EL31 at same time; a drain electrode of the third transistor T33 is connected to a gate electrode of the driving transistor T31. A gate electrode of the seventh transistor T37 is connected to the nth row scanning signal line Scan(n); a source electrode of the seventh transistor T37 is connected to a bottom polar plate of the first capacitor C31; a drain electrode of the seventh transistor T37 is connected to a bottom polar plate of the second capacitor C32 and connected to the gate electrode of the driving transistor T31. The upper polar plates of the first capacitor C31 and the second capacitor C32 are accessed the power source voltage VDD, and a cathode of the electroluminescent element EL31 is connected to a common ground end VSS.

In this embodiment, the light emitting signal response module 302 includes a fourth transistor T34; the fourth transistor T34 is for responding to a nth row light emitting signal to transmit the initialization voltage Vinit.

Preferably, the light emitting signal response module 302 further includes a fifth transistor T35; the fifth transistor T35 is for responding to the nth row light emitting signal to provide the power source voltage VDD to the driving transistor T31.

Preferably, the light emitting signal response module 302 further includes a sixth transistor T36; the sixth transistor T36 is for responding to the nth row light emitting signal to provide a driving electric current generated by the driving transistor T31 to the electroluminescent element EL31.

Specifically, in this embodiment, the fourth transistor T34, the fifth transistor T35, the sixth transistor T36, and the driving transistor T31 are PMOS transistors. The gate electrode of the fourth transistor T34 is connected to a nth row light emitting line EM(n), a source electrode of the fourth transistor T34 is connected to a bottom polar plate of the first capacitor C31, and a drain electrode of the fourth transistor T34 is accessed the initialization voltage Vinit. The gate electrode of the fifth transistor T35 is connected to the nth row light emitting line EM(n), a source electrode of the fifth transistor T35 is accessed the power source voltage VDD, and a drain electrode of the fifth transistor T35 is connected to a source electrode of the driving transistor T31. A gate electrode of the sixth transistor T36 is connected to the nth row light emitting line EM(n), a source electrode of the sixth transistor T36 is connected to a drain electrode of the driving transistor T31, and a drain electrode of the sixth transistor T36 is connected to an anode of the electroluminescent element EL31. A gate electrode of the driving transistor T31 is connected to a bottom polar plate of the second capacitor C32. The upper polar plates of the first capacitor C31 and the second capacitor C32 are accessed the power source voltage VDD, and a cathode of the electroluminescent element EL31 is connected to a common ground end VSS.

As illustrated in FIG. 5, during the program period, the nth row scanning signal provided by the nth row scanning signal line Scan(n) is changed from a high electric level to a low electric level, and the scanning signal response module 301 is turned on in response to the nth row scanning signal, that is, the gate electrodes of the transistors T32, T33, and T37 are applied with a low electric level, and the source electrode and the drain electrode are turned on. The scanning signal response module 31 can transmit the data voltage Vdata provided by the data line; the nth row light emitting signal provided by the nth row light emitting line EM(n) is at a high electric level, and the light emitting signal response module 302 is turned off in response to the nth row light emitting signal, that is, the gate electrodes of the transistors T34, T35, and T36 are applied with a high electric level, and the source drain is disconnected from the drain electrode. This is discussed in two situations: (1) The currently transmitted data voltage Vdata is higher than the previously transmitted data voltage Vdata' (Vdata>Vdata'), at this moment, the difference between the currently transmitted data voltage Vdata and the gate voltage Vgate of the driving transistor T31 is greater than the threshold voltage Vth of the driving transistor T31, that is, Vdata−Vgate>Vth; and the first capacitor C31 and the second capacitor C32 are charged electric charges by the data voltage Vdata constantly until the difference between the currently transmitted data voltage Vdata and the threshold voltage Vth of the driving transistor T31 is equal to the gate voltage Vgate of the driving transistor T31, that is, Vgate=Vdata−Vth, and maintain the gate voltage Vgate of the driving transistor T31; 2) The currently transmitted data voltage Vdata is lower than the previously transmitted data voltage Vdata' (Vdata<Vdata'), at this moment, the difference between the currently transmitted data voltage Vdata and the gate voltage Vgate of the driving transistor T31 is lower than the threshold voltage Vth of the driving transistor T31, that is, Vdata−Vgate<Vth, and the source electrode and the drain electrode of the driving transistor T31 are disconnected; the initialization voltage Vinit (the polarity is opposite to the polarity of the currently transmitted data voltage Vdata) stored in the first capacitor C31 flows to the second capacitor C32, making the gate voltage Vgate of the driving transistor T31 continuously lower until the difference between the currently transmitted data voltage Vdata and the threshold voltage Vth of the driving transistor T31 is equal to the gate voltage Vgate of the driving transistor T31, that is, Vgate=Vdata−Vth; at this moment, the source electrode and the drain electrode of the driving transistor T31 are turned on, and the currently transmitted data voltage Vdata continuously neutralizes the initialization voltage Vinit with the opposite polarity in the first capacitor C31 to maintain the gate voltage Vgate of the driving transistor T31. Meanwhile, the threshold voltage Vth drift of the driving transistor T31 can be compensated.

During the light emitting period, the nth row scanning signal provided by the nth row scanning signal line Scan(n) is at a high level, and the scanning signal response module 301 is turned off in response to the nth row scanning signal, that is, the gate electrodes of the transistors T32, T33, and T37 are applied with a high electric level, and the source electrode and the drain electrode are disconnected; the nth row light emitting signal provided by the nth row light emitting line EM(n) is at a low level, and the light emitting signal response module 302 is turned on in response to the nth row light emitting signal, that is, the gates electrodes of the transistors T34, T35, and T36 are applied with a low electric level, and the source electrode and the drain electrode are turned on, and the light emitting signal response module 302 can transmit the initialization voltage Vinit. The first capacitor C31 is turned on with the initialization voltage Vinit to store the initialization voltage Vinit. The driving transistor T31 generates the driving electric current according to the data voltage Vdata to drive electroluminescent element EL31 to emit light.

At this moment, the gate voltage Vgate of the driving transistor T31 is maintained, and the driving electric current I conforms to the formula: I=½K(Vgs−Vth)2, thereby ensuring the driving current during the light emitting period remains unchanged. Wherein, Vgs represents the voltage between the source electrode and the gate electrode of the driving transistor T31, Vth represents the threshold voltage of the driving transistor T31, and K represents a constant value.

Meanwhile, since Vgs=VDD−Vgate and Vgate=Vdata−Vth, the driving electric current I can also be expressed as: $I=\frac{1}{2}K*(Vdata-VDD)^2$, that is, the threshold voltage Vth drift of the driving transistor T31 is also compensated. Wherein, Vgs represents the voltage between the source electrode and the gate of electrode the driving transistor T31, Vth represents the threshold voltage of the driving transistor T31, VDD represents the power source voltage, Vgate represents the gate voltage of the driving transistor T31, Vdata represents the data voltage, and K represents a constant value.

The pixel circuit of the organic light emitting device disclosed in the present disclosure includes seven transistors and two capacitors, and through completing initialization in synchronization during the program period, maintaining a gate voltage of a driving transistor, and compensating for a threshold voltage drift in the driving transistor, two steps of a pixel circuit duty cycle (the program period and the light emitting period) can be realized, thereby improving the response speed of the organic light emitting device, and increasing the refresh rate of the display panel.

The present disclosure further provides an organic light emitting display panel, and the display panel includes a pixel circuit, and the pixel circuit includes a driving transistor and a electroluminescent element; the pixel circuit further includes: a scanning signal response module for responding to a nth row scanning signal to transmit a data voltage to maintain a gate voltage of the driving transistor and to compensate threshold voltage drift of the driving transistor, and wherein n is a positive integer greater than 1; a light emitting signal response module for responding to a nth row light emitting signal to transmit an initialization voltage; and polarities of the initialization voltage and the data voltage are opposite; a first capacitor for storing the initialization voltage when the light emitting signal response module is turned on, storing the data voltage, or releasing the stored initialization voltage when the scanning signal response module is turned on; a second capacitor is for storing the data voltage, or storing the data voltage and the initialization voltage released by the first capacitor when the scanning signal response module is turned on; the driving transistor is for generating the driving electric current according to the data voltage; and the electroluminescent element is for emitting light according to the driving electric current. Specifically, the pixel circuit of the organic light emitting device could refer to the description of the pixel circuit in FIG. 3 to FIG. 5, and details are not described herein again.

The pixel circuit includes seven transistors and two capacitors, and through completing initialization in synchronization during the program period, maintaining a gate voltage of a driving transistor, and compensating for a threshold voltage drift in the driving transistor, two steps of a pixel circuit duty cycle (the program period and the light emitting period) can be realized, thereby improving the response speed of the organic light emitting device, and increasing the refresh rate of the display panel.

The subject matter of the present disclosure can be manufactured and applied in the industry and has industrial applicability.

What is claimed is:

1. A pixel circuit of an organic light emitting device, comprising a first transistor, a second transistor, a third transistor, a fourth transistor, a fifth transistor, a sixth transistor, a seventh transistor, and an electroluminescent element; wherein the pixel circuit comprises: a scanning signal response module, a light emitting signal response module, a first capacitor and a second capacitor;

the scanning signal response module comprises the second transistor, the third transistor and the seventh transistor; the second transistor is for responding to a nth row scanning signal to transmit a data voltage; the third transistor is for responding to the nth row scanning signal to compensate threshold voltage drift of the first transistor; the seventh transistor is for responding to the nth row scanning signal to control the first capacitor and the second capacitor to store the data voltage, or to control the second capacitor to store the data voltage and an initialization voltage released by the first capacitor, to maintain a gate voltage of the first transistor, and wherein n is a positive integer greater than 1;

the light emitting signal response module comprises the fourth transistor, the fifth transistor, and the sixth transistor; the fourth transistor is for responding to a nth row light emitting signal to transmit the initialization voltage; the fifth transistor is for responding to the nth row light emitting signal to provide a power source voltage to the first transistor; the sixth transistor is for responding to the nth row light emitting signal to provide a driving electric current generated by the first transistor to the electroluminescent element, and polarities of the initialization voltage and the data voltage are opposite;

the first capacitor is for storing the initialization voltage when the light emitting signal response module is turned on, storing the data voltage, or releasing the stored initialization voltage when the scanning signal response module is turned on;

the second capacitor is for storing the data voltage, or storing the data voltage and the initialization voltage released by the first capacitor when the scanning signal response module is turned on; the first transistor is for generating the driving electric current according to the data voltage; and the electroluminescent element is for emitting light according to the driving electric current.

2. The pixel circuit as claimed in claim 1, wherein during a program period, the scanning signal response module responds to the nth row scanning signal and is turned on, the light emitting signal response module responds to the nth row light emitting signal and is turned off; the scanning signal response module transmits the data voltage; and when the currently transmitted data voltage is higher than the previously transmitted data voltage, the first capacitor and the second capacitor store the currently transmitted data voltage; when the currently transmitted data voltage is lower than the previously transmitted data voltage, the first capacitor releases the stored initialization voltage, the second capacitor stores the currently transmitted data voltage and stores the initialization voltage released by the first capacitor to maintain the gate voltage of the first transistor and compensate the threshold voltage drift of the first transistor;

during a light emitting period, the scanning signal response module responds to the nth row scanning signal and is turned off, the light emitting signal response module responds to the nth row light emitting signal and is turned on; the light emitting signal response module transmits the initialization voltage, the first capacitor stores the initialization voltage, the first transistor generates the driving electric current to drive the electroluminescent element to emit light.

3. The pixel circuit as claimed in claim 1, wherein the second transistor, the third transistor, the seventh transistor, and the first transistor are positive channel metal oxide semiconductor (PMOS) transistors;

a gate electrode of the second transistor is connected to a nth row scanning signal line, a source electrode of the second transistor is accessed the data voltage, and a drain electrode of the second transistor is connected to a source electrode of the first transistor;

a gate electrode of the third transistor is connected to the nth row scanning signal line, a source electrode of the third transistor is connected to a drain electrode of the first transistor and coupled to an anode of the electroluminescent element, and a drain electrode of the third transistor is connected to a gate electrode of the first transistor;

a gate electrode of the seventh transistor is connected to the nth row scanning signal line, a source electrode of the seventh transistor is connected to a bottom polar plate of the first capacitor, and a drain electrode of the seventh transistor is connected to a bottom polar plate of the second capacitor and connected to the gate electrode of the first transistor;

upper polar plates of the first capacitor and the second capacitor are accessed the power source voltage, and a cathode of the electroluminescent element is connected to a common ground end.

4. The pixel circuit as claimed in claim 1, wherein the fourth transistor, the fifth transistor, the sixth transistor, and the first transistor are PMOS transistors;

a gate electrode of the fourth transistor is connected to a nth row light emitting line, a source electrode of the fourth transistor is connected to a bottom polar plate of the first capacitor, and a drain electrode of the fourth transistor is accessed the initialization voltage;

a gate electrode of the fifth transistor is connected to the nth row light emitting line, a source electrode of the fifth transistor is accessed the power source voltage, and a drain electrode of the fifth transistor is connected to a source electrode of the first transistor;

a gate electrode of the sixth transistor is connected to the nth row light emitting line, a source electrode of the sixth transistor is connected to a drain electrode of the first transistor, and a drain electrode of the sixth transistor is connected to an anode of the electroluminescent element;

a gate electrode of the first transistor is connected to a bottom polar plate of the second capacitor, upper polar plates of the first capacitor and the second capacitor are accessed the power source voltage, and a cathode of the electroluminescent element is connected to a common ground end.

5. A pixel circuit of an organic light emitting device, comprising a first transistor, a second transistor, a third transistor, a fourth transistor, a fifth transistor, a sixth transistor, a seventh transistor and an electroluminescent element; wherein the pixel circuit comprises:

a scanning signal response module for responding to a nth row scanning signal to transmit a data voltage to maintain a gate voltage of the first transistor and to compensate threshold voltage drift of the first transistor, and wherein n is a positive integer greater than 1;

a light emitting signal response module for responding to a nth row light emitting signal to transmit an initialization voltage, and polarities of the initialization voltage and the data voltage are opposite;

a first capacitor for storing the initialization voltage when the light emitting signal response module is turned on, storing the data voltage, or releasing the stored initialization voltage when the scanning signal response module is turned on;

and a second capacitor for storing the data voltage when the scanning signal response module is turned on, or storing the data voltage and the initialization voltage released by the first capacitor when the scanning signal response module is turned on;

the first transistor for generating a driving electric current according to the data voltage;

the electroluminescent element is for emitting light according to the driving electric current.

6. The pixel circuit as claimed in claim 5, wherein during a program period, the scanning signal response module responds to the nth row scanning signal and is turned on, the light emitting signal response module responds to the nth row light emitting signal and is turned off; the scanning signal response module transmits the data voltage; and when the currently transmitted data voltage is higher than the previously transmitted data voltage, the first capacitor and the second capacitor store the currently transmitted data voltage; when the currently transmitted data voltage is lower than the previously transmitted data voltage, the first capacitor releases the stored initialization voltage, the second capacitor stores the currently transmitted data voltage and stores the initialization voltage released by the first capacitor to maintain the gate voltage of the first transistor and compensate threshold voltage drift of the first transistor;

during a light emitting period, the scanning signal response module responds to the nth row scanning signal and is turned off, the light emitting signal response module responds to the nth row light emitting signal and is turned on; the light emitting signal response module transmits the initialization voltage, the first capacitor stores the initialization voltage, the first transistor generates the driving electric current to drive the electroluminescent element to emit light.

7. The pixel circuit as claimed in claim 5, wherein the scanning signal response module comprises the second transistor, the third transistor and the seventh transistor;

the second transistor is for responding to the nth row scanning signal to transmit the data voltage;

the third transistor is for responding to the nth row scanning signal to compensate the threshold voltage drift of the first transistor;

the seventh transistor is for responding to the nth row scanning signal to control the first capacitor and the second capacitor to store the data voltage, or to control the second capacitor to store the data voltage and the initialization voltage released by the first capacitor to maintain the gate voltage of the first transistor.

8. The pixel circuit as claimed in claim 7, wherein the second transistor, the third transistor, the seventh transistor, and the first transistor are positive channel metal oxide semiconductor (PMOS) transistors;

a gate electrode of the second transistor is connected to a nth row scanning signal line, a source electrode of the second transistor is accessed the data voltage, and a drain electrode of the second transistor is connected to a source electrode of the first transistor;

a gate electrode of the third transistor is connected to the nth row scanning signal line, a source electrode of the third transistor is connected to a drain electrode of the first transistor and coupled to an anode of the electroluminescent element, and a drain electrode of the third transistor is connected to a gate electrode of the first transistor;

a gate electrode of the seventh transistor is connected to the nth row scanning signal line, a source electrode of the seventh transistor is connected to a bottom polar plate of the first capacitor, and a drain electrode of the seventh transistor is connected to a bottom polar plate of the second capacitor and connected to the gate electrode of the first transistor;

upper polar plates of the first capacitor and the second capacitor are accessed a power source voltage, and a cathode of the electroluminescent element is connected to a common ground end.

9. The pixel circuit as claimed in claim 5, wherein the light emitting signal response module comprises the fourth transistor; the fourth transistor is for responding to the nth row light emitting signal to transmit the initialization voltage.

10. The pixel circuit as claimed in claim 9, wherein the fourth transistor and the first transistor are PMOS transistors;

a gate electrode of the fourth transistor is connected to a nth row light emitting line, a source electrode of the fourth transistor is connected to a bottom polar plate of the first capacitor, and a drain electrode of the fourth transistor is accessed the initialization voltage;

a gate electrode of the first transistor is connected to a bottom polar plate of the second capacitor, a source electrode of the first transistor is coupled to a power source voltage, a drain electrode of the first transistor is coupled to an anode of the electroluminescent element;

upper polar plates of the first capacitor and the second capacitor are accessed the power source voltage, and a cathode of the electroluminescent element is connected to a common ground end.

11. The pixel circuit as claimed in claim 9, wherein the light emitting signal response module comprises the fifth transistor;

the fifth transistor is for responding to the nth row light emitting signal to provide a power source voltage to the first transistor.

12. The pixel circuit as claimed in claim 11, wherein the fourth transistor, the fifth transistor, and the first transistor are PMOS transistors;

a gate electrode of the fourth transistor is connected to a nth row light emitting line, a source electrode of the fourth transistor is connected to a bottom polar plate of the first capacitor, and a drain electrode of the fourth transistor is accessed the initialization voltage;

a gate electrode of the fifth transistor is connected to the nth row light emitting line, a source electrode of the fifth transistor is accessed a power source voltage, and a drain electrode of the fifth transistor is connected to a source electrode of the first transistor;

a gate electrode of the first transistor is connected to a bottom polar plate of the second capacitor, and a drain electrode of the first transistor is coupled to an anode of the electroluminescent element;

upper polar plates of the first capacitor and the second capacitor are accessed the power source voltage, and a cathode of the electroluminescent element is connected to a common ground end.

13. The pixel circuit as claimed in claim 9, wherein the light emitting signal response module comprises the sixth transistor;

the sixth transistor is for responding to the nth row light emitting signal to provide the driving electric current generated by the first transistor to the electroluminescent element.

14. The pixel circuit as claimed in claim 13, wherein the fourth transistor, the sixth transistor, and the first transistor are PMOS transistors;

a gate electrode of the fourth transistor is accessed the nth row light emitting line, a source electrode of the fourth transistor is connected to a bottom polar plate of the first capacitor, and a drain electrode of the fourth transistor is accessed the initialization voltage;

a gate electrode of the sixth transistor is connected to the nth row light emitting line, a source electrode of the sixth transistor is connected to a drain electrode of the first transistor, and a drain electrode of the sixth transistor is connected to an anode of the electroluminescent element;

a gate electrode of the first transistor is connected to a bottom polar plate of the second capacitor, a source electrode of the first transistor is coupled to a power source voltage;

upper polar plates of the first capacitor and the second capacitor are accessed the power source voltage, and a cathode of the electroluminescent element is connected to a common ground end.

15. An organic light emitting display panel comprising at least one pixel circuit, and the pixel circuit comprising a first transistor, a second transistor, a third transistor, a fourth transistor, a fifth transistor, a sixth transistor, a seventh transistor, and an electroluminescent element; wherein the pixel circuit further comprises:

a scanning signal response module for responding to a nth row scanning signal to transmit a data voltage to maintain a gate voltage of the first transistor and to compensate threshold voltage drift of the first transistor, and wherein n is a positive integer greater than 1;

a light emitting signal response module for responding to a nth row light emitting signal to transmit an initialization voltage; and wherein polarities of the initialization voltage and the data voltage are opposite;

a first capacitor for storing the initialization voltage when the light emitting signal response module is turned on, storing the data voltage, or releasing the stored initialization voltage when the scanning signal response module is turned on;

a second capacitor for storing the data voltage when the scanning signal response module is turned on, or storing the data voltage and the initialization voltage released by the first capacitor when the scanning signal response module is turned on;

the first transistor for generating a driving electric current according to the data voltage; and the electroluminescent element for emitting light according to the driving electric current.

16. The organic light emitting display panel as claimed in claim 15, wherein during a program period, the scanning signal response module responds to the nth row scanning signal and is turned on, the light emitting signal response module responds to the nth row light emitting signal and is turned off; the scanning signal response module transmits the data voltage; and when the currently transmitted data voltage is higher than the previously transmitted data voltage, the first capacitor and the second capacitor store the currently transmitted data voltage; when the currently transmitted data voltage is lower than the previously transmitted data voltage, the first capacitor releases the stored initialization voltage, the second capacitor stores the currently transmitted data voltage and stores the initialization voltage released by the first capacitor to maintain the gate voltage of the first transistor and compensate threshold voltage drift of the first transistor;

during a light emitting period, the scanning signal response module responds to the nth row scanning signal and is turned off, the light emitting signal response module responds to the nth row light emitting signal and is turned on; the light emitting signal response module transmits the initialization voltage, the first capacitor stores the initialization voltage, the first transistor generates the driving electric current to drive the electroluminescent element to emit light.

17. The organic light emitting display panel as claimed in claim 15, wherein the scanning signal response module comprises the second transistor, the third transistor, and the seventh transistor;

the second transistor is for responding to the nth row scanning signal to transmit the data voltage;

the third transistor is for responding to the nth row scanning signal to compensate threshold voltage drift of the first transistor;

the seventh transistor is for responding to the nth row scanning signal to control the first capacitor and the second capacitor to store the data voltage, or to control the second capacitor to store the data voltage and the initialization voltage released by the first capacitor to maintain the gate voltage of the first transistor.

18. The organic light emitting display panel as claimed in claim 17, wherein the second transistor, the third transistor, the seventh transistor, and the first transistor are positive channel metal oxide semiconductor (PMOS) transistors;

a gate electrode of the second transistor is connected to a nth row scanning signal line, a source electrode of the second transistor is accessed the data voltage, and a drain electrode of the second transistor is connected to a source electrode of the first transistor;

a gate electrode of the third transistor is connected to the nth row scanning signal line, a source electrode of the third transistor is connected to a drain electrode of the first transistor and coupled to an anode of the electroluminescent element, and a drain electrode of the third transistor is connected to a gate electrode of the first transistor;

a gate electrode of the seventh transistor is connected to the nth row scanning signal line, a source electrode of the seventh transistor is connected to a bottom polar plate of the first capacitor, and a drain electrode of the seventh transistor is connected to a bottom polar plate of the second capacitor and connected to the gate electrode of the first transistor;

upper polar plates of the first capacitor and the second capacitor are accessed a power source voltage, and a cathode of the electroluminescent element is connected to a common ground end.

19. The organic light emitting display panel as claimed in claim 15, wherein the light emitting signal response module comprises the fourth transistor, the fifth transistor, and the sixth transistor;

the fourth transistor is for responding to the nth row light emitting signal to transmit the initialization voltage;

the fifth transistor is for responding to the nth row light emitting signal to provide a power source voltage to the first transistor;

the sixth transistor is for responding to the nth row light emitting signal to provide the driving electric current generated by the first transistor to the electroluminescent element.

20. The organic light emitting display panel as claimed in claim 15, wherein the fourth transistor, the fifth transistor, the sixth transistor, and the first transistor are PMOS transistors;

a gate electrode of the fourth transistor is connected to a nth row light emitting line, a source electrode of the fourth transistor is connected to a bottom polar plate of the first capacitor, and a drain electrode of the fourth transistor is accessed the initialization voltage;

a gate electrode of the fifth transistor is connected to the nth row light emitting line, a source electrode of the fifth transistor is accessed a power source voltage, and a drain electrode of the fifth transistor is connected to a source electrode of the first transistor;

a gate electrode of the sixth transistor is connected to the nth row light emitting line, a source electrode of the sixth transistor is connected to a drain electrode of the first transistor, and a drain electrode of the sixth transistor is connected to an anode of the electroluminescent element;

a gate electrode of the first transistor is connected to a bottom polar plate of the second capacitor, upper polar plates of the first capacitor and the second capacitor are accessed the power source voltage, and a cathode of the electroluminescent element is connected to a common ground end.

* * * * *